US005193562A

United States Patent [19]

Rigby et al.

[11] Patent Number: 5,193,562

[45] Date of Patent: Mar. 16, 1993

[54] DISHWASHER

[75] Inventors: Ralph A. Rigby, East Lindfield; Bryan H. Marshall, Glebe; Peter K. Le Leivre, Dee Why; Stuart A. Morley, Rydalmere, all of Australia

[73] Assignee: McIlwraith-Davey Pty Ltd., Revesby, Australia

[21] Appl. No.: 604,478

[22] Filed: Oct. 25, 1990

[30] Foreign Application Priority Data

Oct. 25, 1989 [AU] Australia ..... PJ7058

[51] Int. Cl.[5] ..... B08B 3/04

[52] U.S. Cl. ..... 134/57 D; 134/100.1; 134/115 R; 134/176; 134/179; 134/180

[58] Field of Search ..... 134/57 D, 56 D, 115, 134/111, 176, 179, 180, 100, 200, 182, 172, 155, 184, 100.1

[56] References Cited

U.S. PATENT DOCUMENTS

| | | | |
|---|---|---|---|
| 1,819,355 | 8/1931 | Brotz | 134/57 D |
| 2,669,240 | 2/1954 | Thorson | 134/95 |
| 2,681,658 | 6/1954 | Meeker et al. | 134/111 |
| 2,701,574 | 2/1955 | Hollerith | 134/57 D |
| 2,965,112 | 12/1960 | Getchell et al. | 134/176 |
| 3,358,702 | 12/1967 | Schaap | 134/58 |
| 3,415,276 | 12/1968 | Lind et al. | 137/563 |
| 3,863,657 | 2/1975 | Irving | 134/57 D |

FOREIGN PATENT DOCUMENTS

| | | |
|---|---|---|
| 0262932A3 | 4/1988 | European Pat. Off. . |
| 473575 | 3/1967 | Switzerland . |

*Primary Examiner*—Frankie L. Stinson

*Attorney, Agent, or Firm*—Fitch, Even, Tabin & Flannery

[57] ABSTRACT

The present invention discloses a sink mounted dishwasher having a closure mechanism (41, 140) in the drain (15) of the sink (2). An hydraulic control system (FIG. 6) for such a dishwasher is also disclosed together with an hydraulically operated liquid detergent dispenser (47, FIG. 7). The preferred form of hydraulic fluid is liquid rinse aid. Two forms of spray arm (28, 128) are also disclosed, each with a structure (20) which enables the spray arm to be removably and rotatably mounted within the sink.

25 Claims, 8 Drawing Sheets

DISHWASHER

Figure 1:
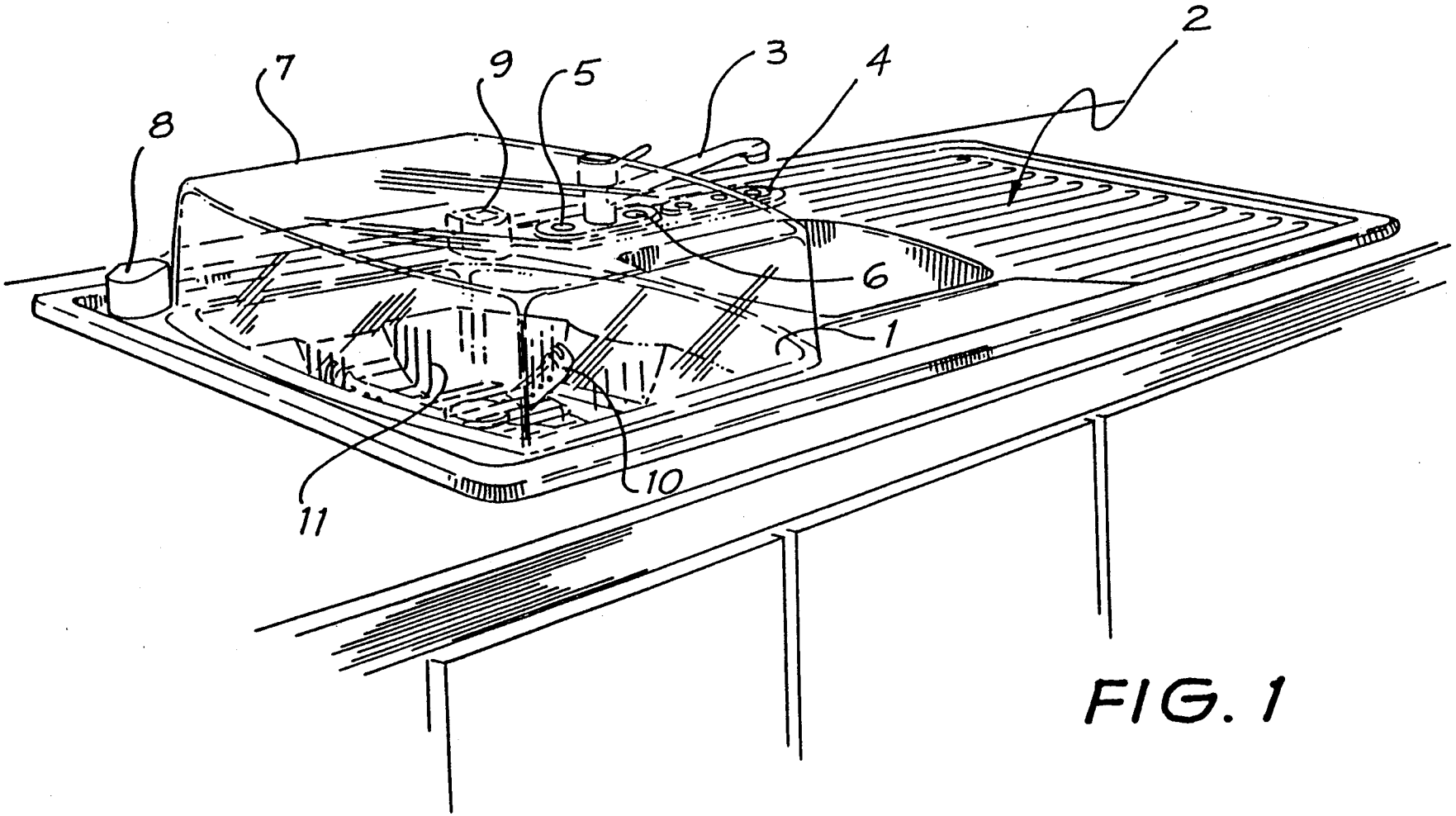

The present invention relates to dishwashers and, in particular to sink mounted dishwashers in which the sink bowl constitutes the receptacle into which the dirty dishes and utensils are placed in order to be washed.

Such dishwashers are known and that disclosed in Australian Patent Application No. 78927/87 (which corresponds to U.S. Pat. No. 4,919,162) by the same assignee as that of applicants represents a starting point for the present invention. The present invention arises out of further refinement and development of the above mentioned prior art.

Accordingly, it is an object of the present invention to improve various aspects of the above mentioned prior art dishwasher and, in particular, to improve the closure mechanism by which the drain of the sink is blocked during a washing cycle, to provide a control system for the dishwasher, to improve the mounting of the spray arm, and to dispense liquid dishwasher detergent which suffers from the problem that it tends to clog conventional dispensers if the dishwasher is left unoperated as would be the case when the occupants of a household are absent during an annual vacation, for example. All these aspects or facets combine to produce a much improved dishwasher which is disclosed herein.

According to a first aspect of the present invention there is disclosed a sink mounted dishwasher comprising a sink having a base and side walls, a drain located in said base, a spray arm removably and rotatably mounted in said sink and rotatable by water directed into said spray arm by a pump connected to said drain wherein a drain closure member is mounted in said drain elbow the pump connection and is operable between a drain closed configuration in which water in said sink can be circulated by said pump through said spray arm, and a drain open configuration in which water in said sink is drained through said drain closure member.

According to a second aspect of the present invention there is disclosed an hydraulic control system for a dishwasher having an hydraulically operated liquid detergent dispenser and an hydraulically operated drain closure member, said system comprising a reservoir for liquid rinse aid, a pump having an inlet connected to said reservoir and an outlet connected to three solenoid valves, a first one of said solenoid valves communicating said rinse aid to said detergent dispenser to hydraulically control the operation of same, a second one of said solenoid valves communicating said rinse aid to said drain closure member to hydraulically control the operation of same, and the third one of said solenoid valves connecting said rinse aid to said dishwasher to dispense same. Preferably the rinse aid is dispensed into the outlet of the liquid detergent dispenser.

According to a third aspect of the present invention there is disclosed a spray arm mounting arrangement for a dishwasher mounted in a sink having a drain, said arrangement comprising a substantially cylindrical hollow body dimensioned to be insertable into said drain, a collar substantially co-axial with said cylindrical body and located at one, upper, end thereof by a plurality of supporting webs, said collar supporting said spray arm, a hollow elbow interconnecting said collar with an opening in the side wall of said body communicable with a pump outlet, said elbow communicating said pump outlet with a hollow interior of said spray arm via said collar without obstructing liquid draining from said sink between said webs and through said hollow body. Preferably the spray arm has an upper and a lower tier and water passing through said collar is directed into both said tiers via a dual co-axial poppet valve seated within said collar. Preferably part of said body is perforated and comprises a filter leading to a pump inlet whereby ay residue remaining on said filter near the end of each dishwasher cycle is washed from said filter as water is drained from the sink.

According to a fourth aspect of the present invention there is disclosed a dispenser for readily dried liquids such as dishwasher liquid detergent, said dispenser being located in a water supply line and comprising a liquid tight housing divided into two compartments by a diaphragm, one of said compartments having an inlet and an outlet for connection to said water supply line, and a connection to a source of said liquid closed by a poppet valve having a stem extending into said one compartment and secured to said diaphragm, biasing means to urge said diaphragm away from said connection to thereby maintain said poppet valve normally closed, and the other of said compartments being connectable to a source of hydraulic fluid to pressurize said other compartment and move said diaphragm against the urging of said biasing means to thereby open said poppet valve and dispense said liquid into said supply line via said one compartment. Although either a gas or a liquid can be used for the hydraulic fluid, the preferred hydraulic fluid is rinse aid liquid.

According to a fifth aspect of the present invention there is disclosed a drain closure member for a dishwasher mounted in a sink having a drain, said member comprising a hollow torroid of elastically deformable sheet material having its outer surface sealingly secured to the inner surface of said drain, the interior of said torroid being connected to a source of hydraulic fluid, said torrid when not pressurized by said fluid having an aperture therethrough which liquid in said drain can pass, and said torroid when pressurized by said fluid expanding to constrict said aperture and substantially prevent the passage of liquid therethrough. Although either a gas or a liquid can be used as the hydraulic fluid, the preferred hydraulic fluid is rinse aid liquid.

According to a sixth aspect of the present invention there is disclosed a drain closure member for a dishwasher mounted in a sink having a drain, said member comprising a cap mounted for longitudinal reciprocal movement along said drain into and out of an enlarged drain portion, the diameter of said cap corresponding to that of said drain whereby said drain is open only when said cap is in said enlarged portion.

Figure 2:
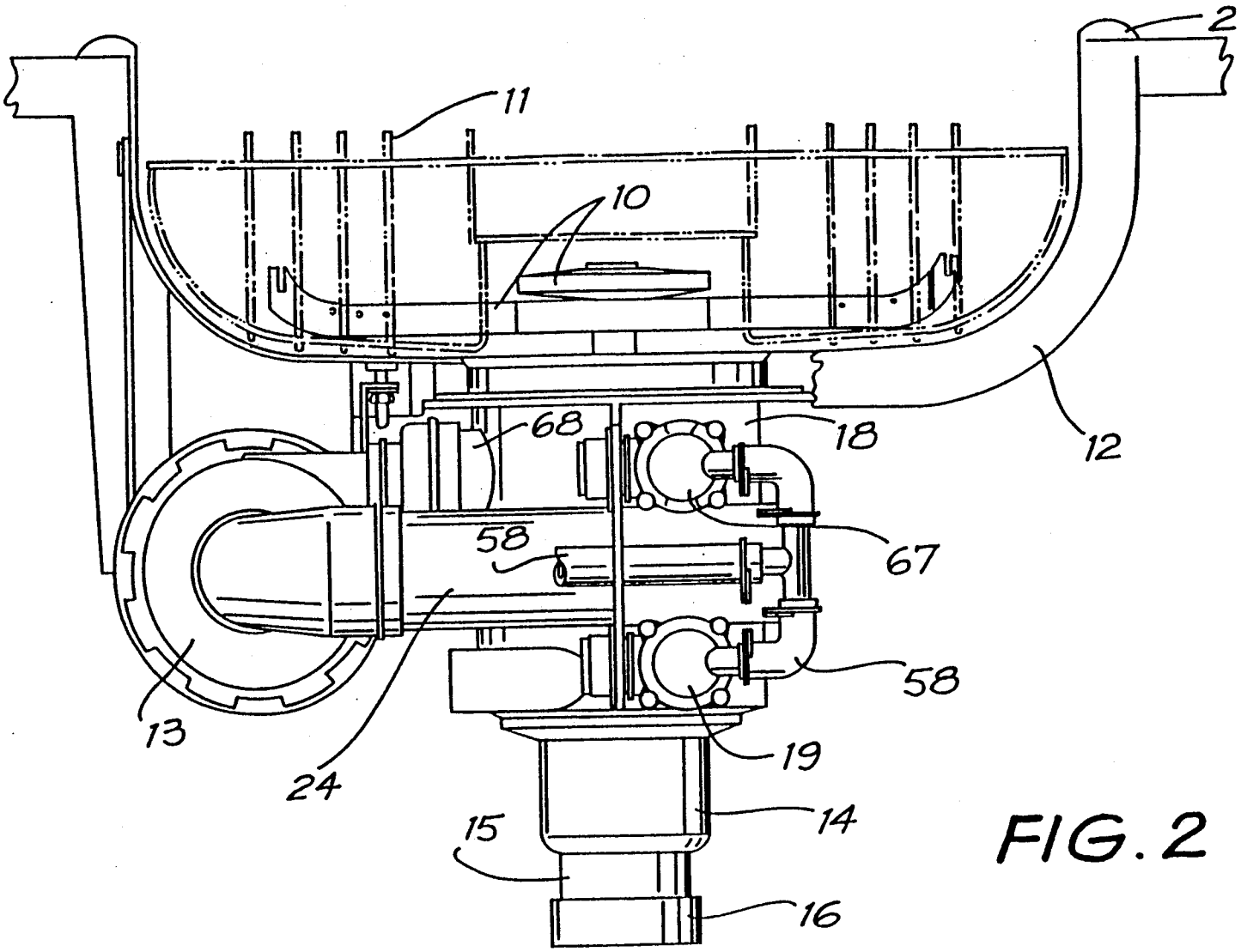
Figure 3:
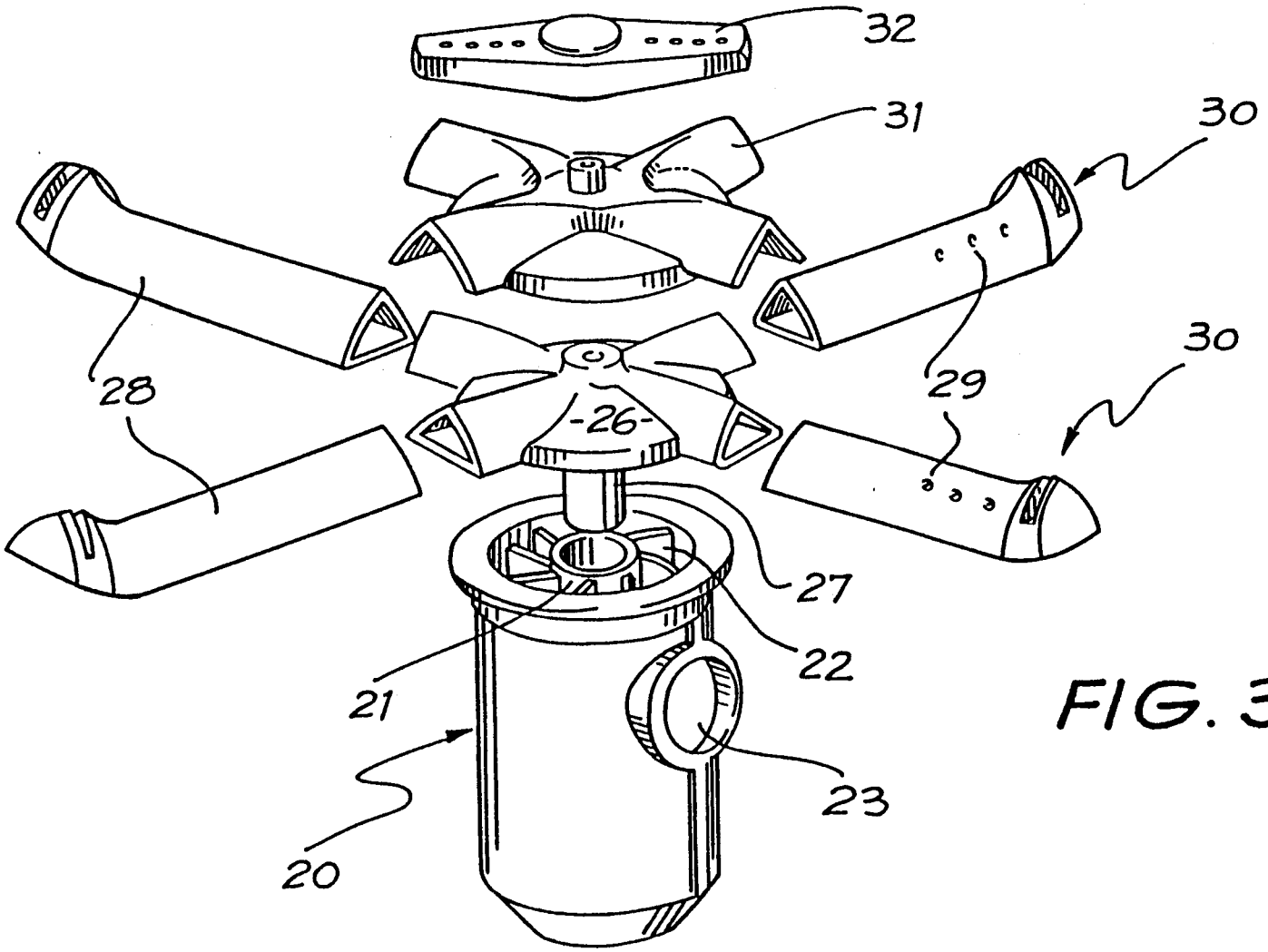
Figure 4:
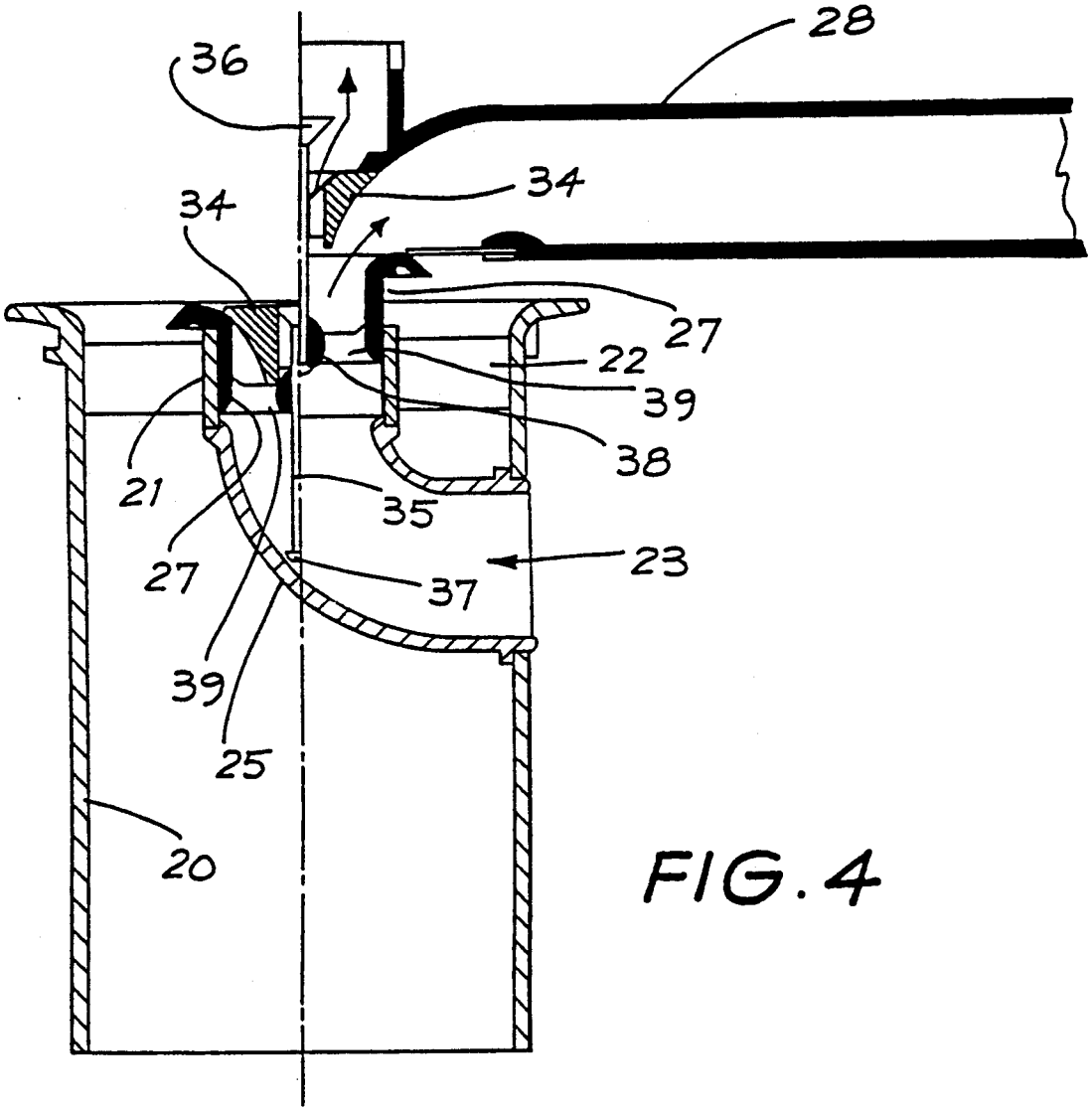
Figure 5:
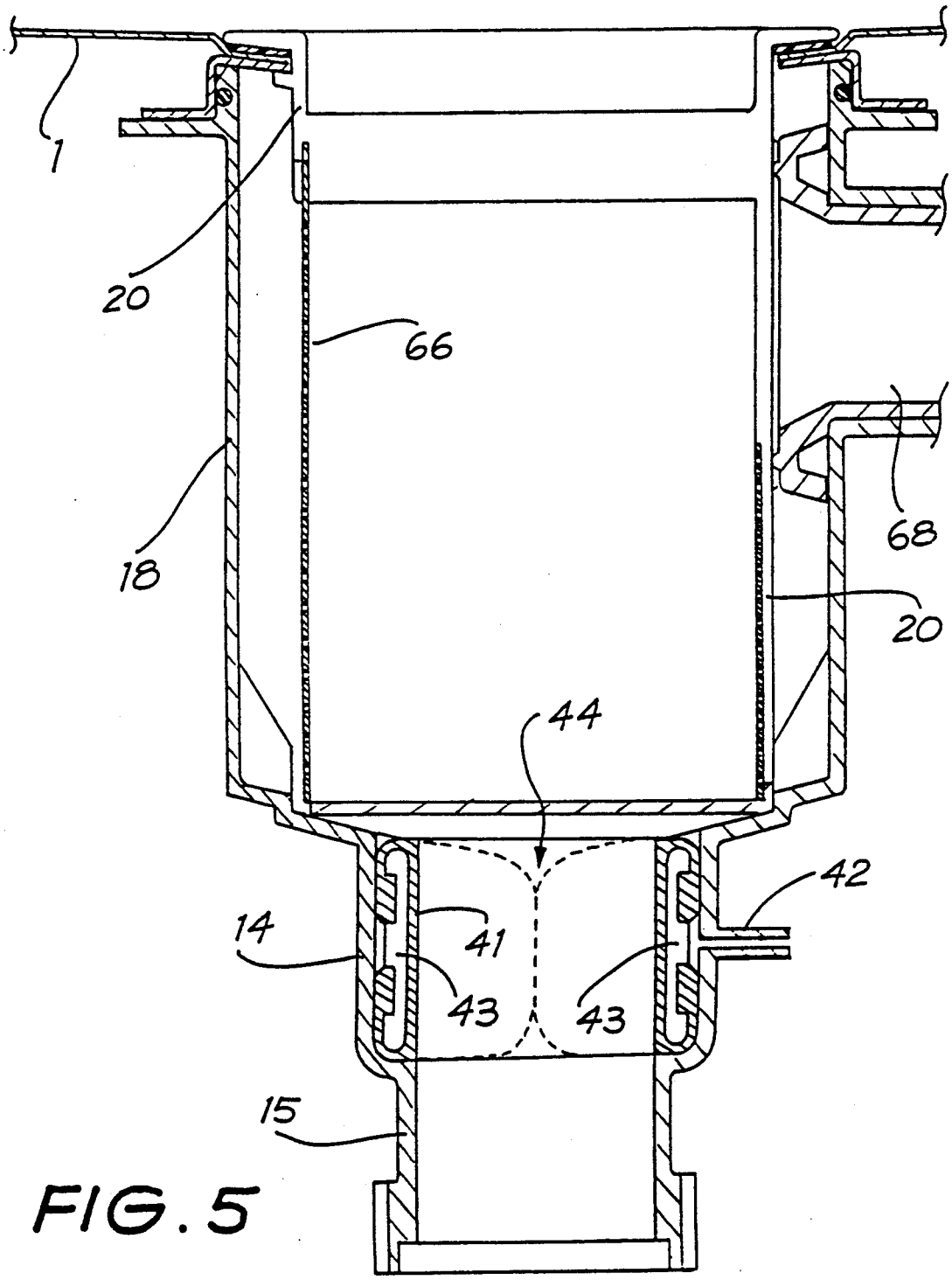
Figure 6:
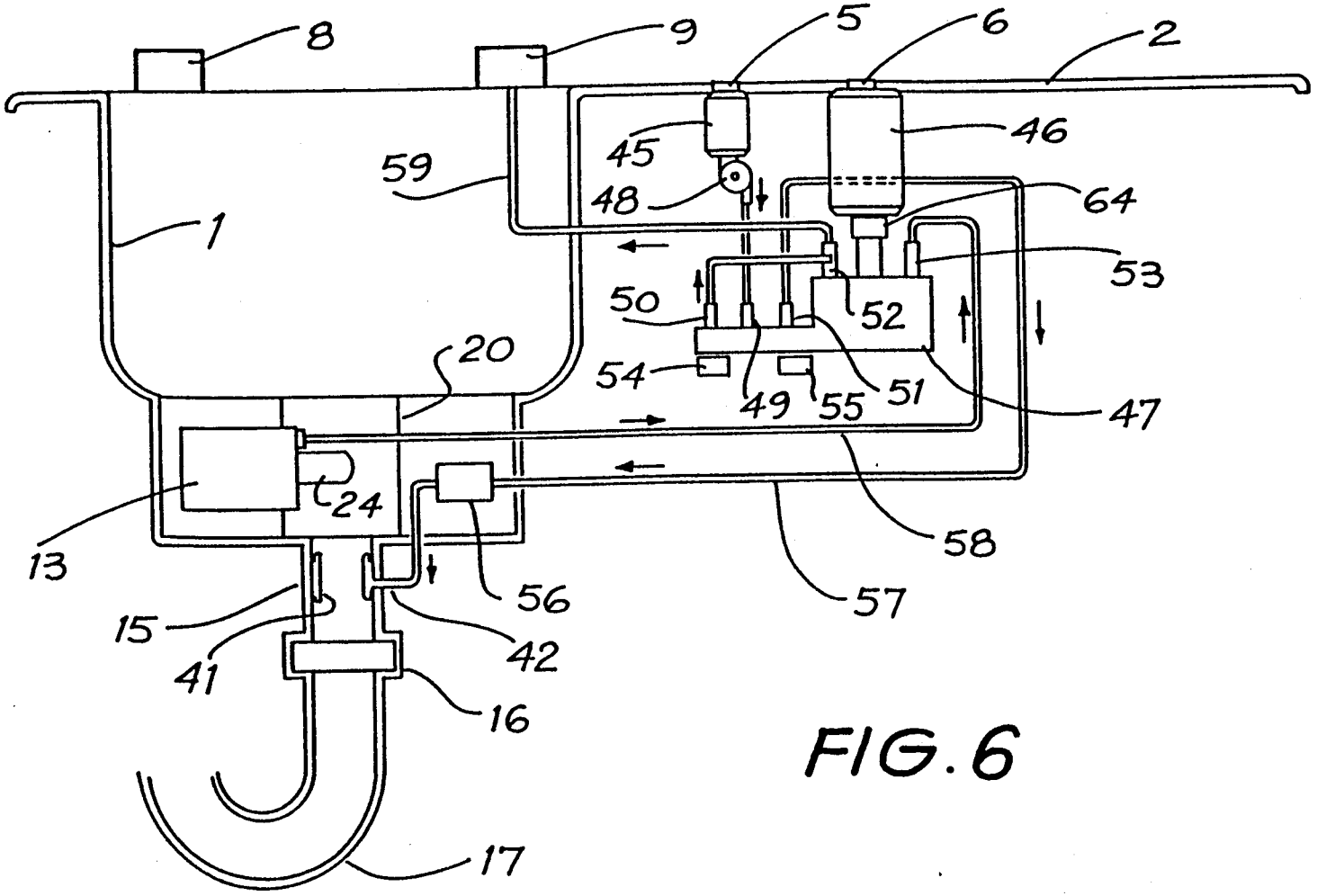
Figure 7:
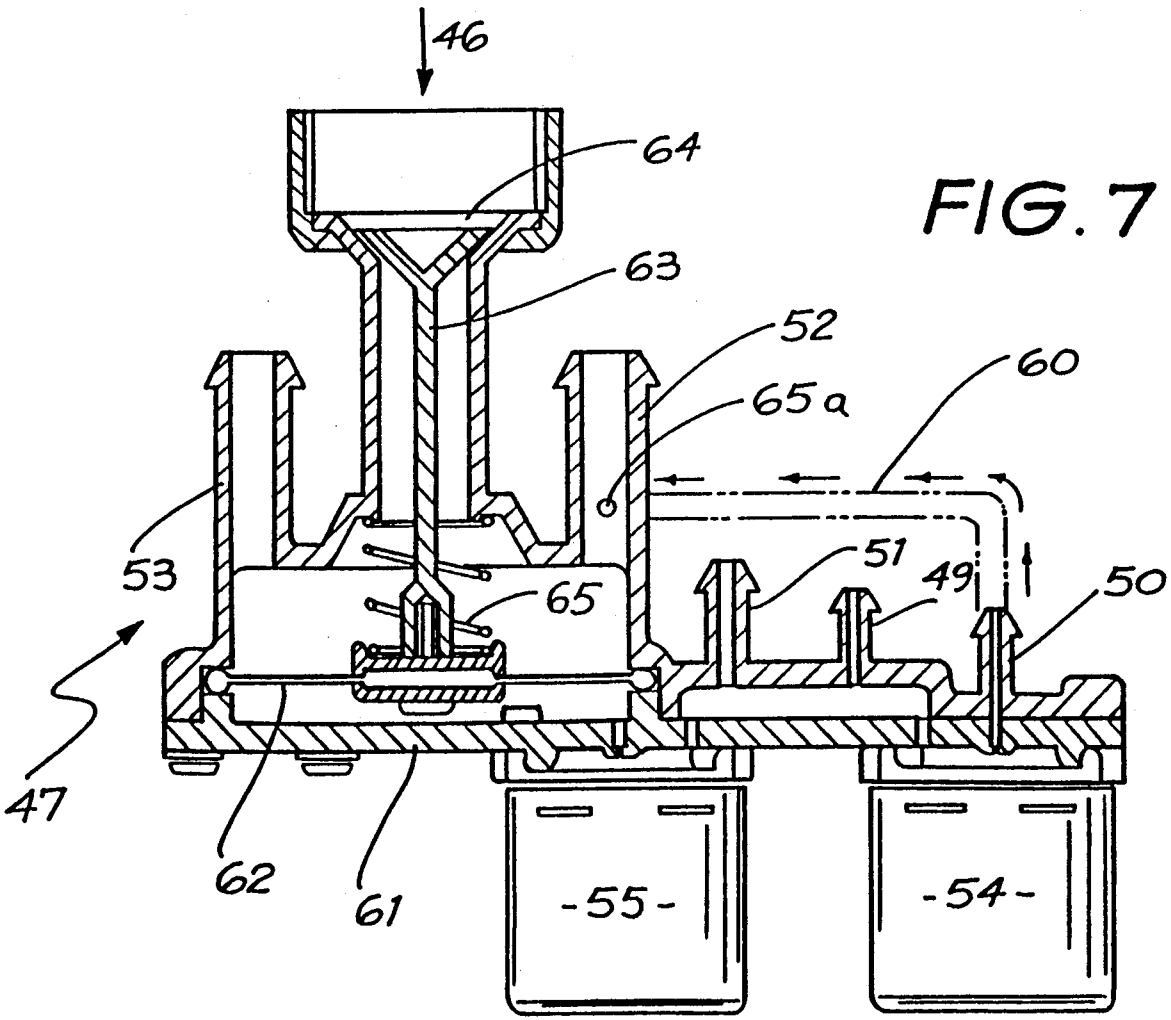
Figure 8:
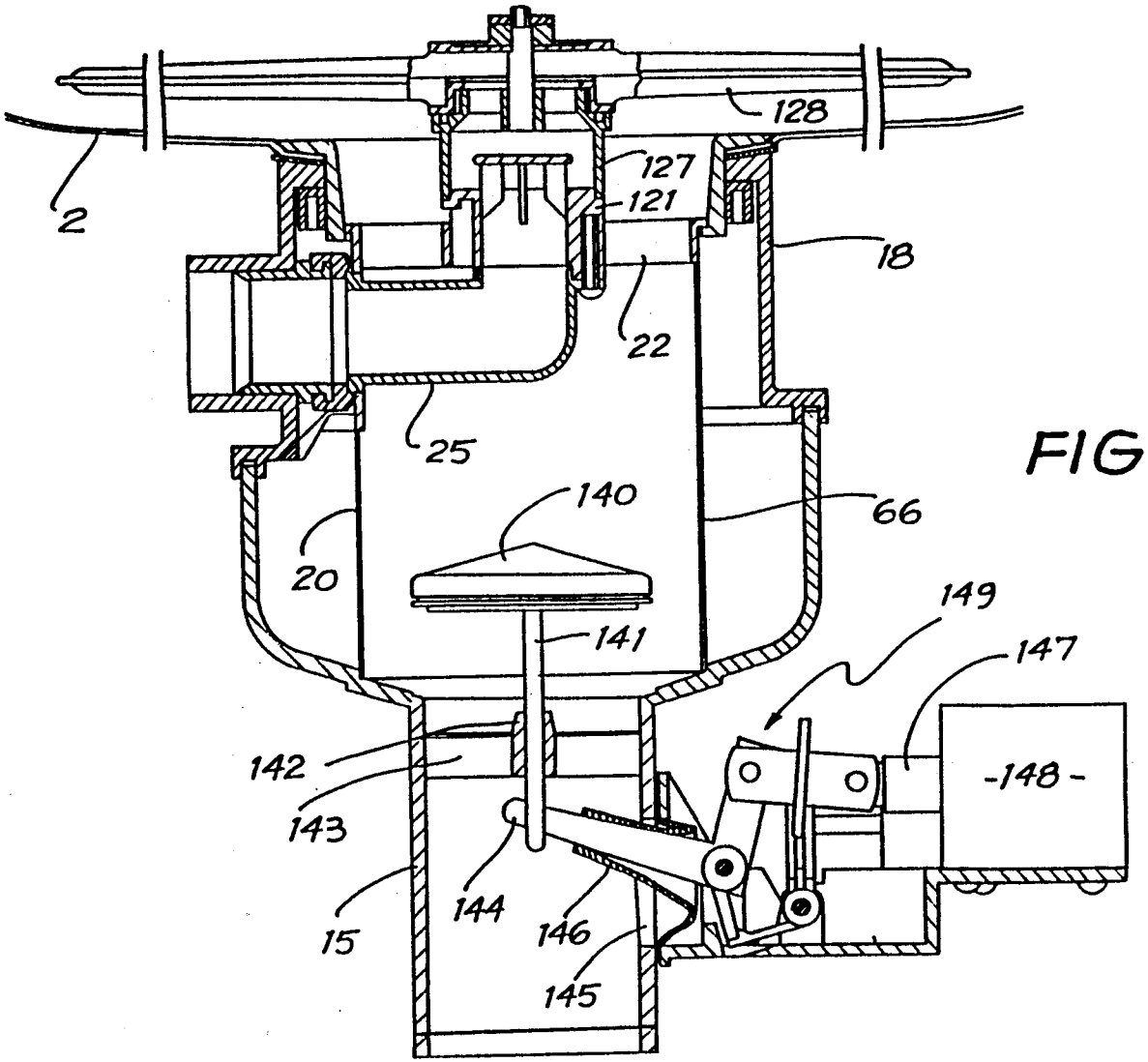

An embodiment of the present invention will now be described with reference to the drawings in which:

FIG. 1 is a perspective view from above of the sink mounted dishwasher,

FIG. 2 is a side elevational view of the apparatus located beneath the sink and of the spray arm arrangement, the sink itself being illustrated in vertical cross-section, FIG. 3 is an exploded perspective view of the spray arm mounting arrangement and hollow drain body, FIG. 4 is a vertical cross-sectional view through the body and spray arm of FIG. 3, FIG. 5 is a schematic vertical cross-sectional view through the drain closure member which is located below the drain body illustrated in FIG. 3, FIG. 6 is a schematic block diagram of the hydraulic control system used in the dishwasher, FIG. 7 is a vertical cross-sectional view through the liquid dishwasher detergent dispenser included in the control system of FIG. 6, and FIG. 8 is a longitudinal sectional view through the base of the sink illustrating an alternative spray arm arrangement and alterative drain closure member.

As seen in FIG. 1, the preferred form of dishwasher in accordance with the present invention is mounted in the larger bowl 1 of a two bowl sink 2 having a centrally located tap or faucet 3 and a control panel 4. Mounted alongside the tap 3 are two releasably sealable openings 5,6 which are respectively used to re-fill rinse aid and detergent into respective container (not illustrated in FIG. 1) mounted below the level of the sink 2.

It will be seen that the bowl 1 is provided with a removable cover 7 which is supported by hinge mountings 8,9. As will be explained hereafter, the hinge mounting 9 is used to provide a concealed entry for liquid into the bowl 1 at a level which is above the maximum possible level of water within the bowl 1. In this way, contamination of the supply line leading to the bowl 1 and/or the mains supply by the bowl contents is avoided Also located within the bowl is a spray arm assembly 10 and a basket 11 for dishes and utensils.

Turning now to FIG. 2, it will be seen that the sink 2 is preferably provided with a thick layer of insulation 12 (illustrated on one side only for clarity) in order to minimize the loss of heat through the thermally conductive stainless steel bowl 1. Also located below the level of the sink 2 is a pump 13 mounted above the outer body of the drain closure member 14 below which extends the drain 15 and the connector 16 by which the drain 15 is connected to an S-trap 17 (FIG. 6). Between the drain closure member 14 and the base of the bowl 1 is a generally cylindrical housing 18. The housing 18 has an outlet 68 connected to the inlet of the pump 13. In addition, the outlet of the pump 13 is returned via pipe 24 to the interior of the housing 18. Two solenoids 19 and 67 are used to selectively connect a water supply line 58 which leads ultimately to the bowl 1 to either a hot water supply or a cold water supply (not illustrated).

The detail of the spray arm assembly 10 and its support (in the form of hollow body 20) are illustrated in FIG. 3. The hollow body 20 is provided with a collar 21 which is co-axially mounted at the upper end of the hollow body 20 by means of a number of generally radially extending webs 22 which together with the collar 21 form a spider. The hollow body 20 is provided with an opening 23 in its side wall which is connected to the outlet of the pump 13 by a pipe 24. (FIGS. 2 and 6). As illustrated in FIG. 4, the collar 21 is also connected to the opening 23 by means of a hollow elbow 25.

As illustrated in FIG. 3, the spray arm assembly 10 takes the form of a central cross-shaped member 26 having a downwardly directed spigot 27 which is rotatably mounted in the collar 21. Connected to the central member 26 is each of four lower spray arms 28 each of which has jets 29 and an upwardly directed spray slot 30. The lower spray arms 28 are clamped in position by means of a cross-shaped clamp 31 which clamps the arms 28 against the central member 26. The spray arm assembly 10 is completed by means of an upper spray arm 32.

FIG. 4 illustrates in schematic form how water is introduced into both the upper spray arm 32 and the four lower spray arms 28. It will be seen that located within the spigot 27 is a two-part poppet valve mechanism 33. The valve mechanism 33 takes the form of an outer valve ring 34 and an inner valve stem 35. The position in the absence of water flow is illustrated on the left hand side of FIG. 4. Here both the outer valve ring 34 and the inner valve stem 35 are in their lower, rest positions with the vale ring 34 abutting the inner surface of the spigot 27 and the head 36 of the valve stem 35 abutting the inner surface of the valve ring 34.

The position when water is supplied from the pump via opening 23 is illustrated on the right and side of FIG. 3. Here, the force of the water raises the outer valve ring 34 so that it allows water to pass upwardly and into the lower spray arms 28. In addition, the outer valve ring 34 is profiled so as to direct only a predetermined portion of the total flow into the lower spray arms 28. The force of the water entering via opening 23 also lifts the valve stem 35 so that its head 36 no longer occludes the central opening in the outer valve ring 34. As a result, some of the water is able to pass between the valve stem 35 and valve ring 34 where it is led upwardly towards, and into, the upper spray arm 32. In this connection, it will be appreciated that the lower end of the valve stem 35 is provided with a boss 37 which limits the upward travel of the valve stem 35. This limit is provided by a sleeve 38 co-axially mounted within the spigot 27 by means of support webs 39.

The interior detail of the drain closure member 14 and cylindrical housing 18 is illustrated in FIG. 5. Located within the drain closure member 14 is a hollow torroid 41 formed from sheet material such as polyurethane which is elastically deformable. By mans of an inlet 42, the interior 43 of torroid 41 is able to be connected to a source of hydraulic fluid which, as will be described hereafter in relation to FIG. 6, preferably takes the form of liquid rinse aid. The outer surfaces of the torroid 41 are connected to the drain closure member 14, for example by means of sealing compound.

As a consequence, in the uninflated condition illustrated by solid lines in FIG. 5, the torroid 41 has a negligible radial extent and therefore allows passage of material through its central aperture 44 and into the drain 15. Accordingly, in this configuration, the torroid 41 allows unobstructed access to the drain 15.

However, when the interior 43 of the torroid 41 is pressurized, the inner surfaces of the torroid 41 expand towards each other so a to adopt the configuration illustrated by broken lines in FIG. 5 in which the aperture 44 is constricted to the point of elimination. As a result, liquid located above the torroid 41 is prevented from gaining access to the drain 15.

The hollow body 20 as illustrated in FIG. 4 is provided with a potion of its side wall formed as a perforated metal sheet which functions as a filter 66. With the torroid 41 expanded to block the drain 15, water can be pumped from the interior of the hollow body 20, through the filter 66, and out the outlet 68 to the pump 13. This water can then be returned via pipe 24 and opening 23 to the spray arms 28, 32 and thence to the bowl 1.

It will be apparent to those skilled in the art that any material which is deposited on the filter 66 can be washed into the drain 15 on the next occasion when the drain closure member 14 is opened while there is water in the bowl 1.

The hydraulic control system for the dishwasher will now be described with reference to FIG. 6. Located beneath the openings 5 and 6 are container 45 and 46 for rinse aid and liquid detergent respectively. The liquid detergent is a suspension of soap particles in a liquid and is highly viscous. In addition, the suspension is prone to settling and drying out. It therefore tends to clog conventional dispenser if left unused for any period of time. The detergent container 46 is directly mounted on a dispenser 47 which is illustrated in more detail in FIG. 7. The rinse aid container 45 is connected via a rinse aid pump 48 to a rinse aid inlet 49 on the dispenser 47.

The dispenser 47 is also provided with a rinse aid outlet 50, a drain connector outlet 51, a water outlet 52 and water inlet 53. Also provided are solenoids 54 and 55. A further solenoid 56 is located in the line 57 connecting the drain connector outlet 51 to the torroid 41 within the drain closure member 14. A water inlet line 58 connects hot water to the water inlet 53 while the water outlet 52 is connected to the hinge mounting 9 by means of a water outlet line 59. A rinse aid line 60 connects the rinse aid outlet 50 to the water outlet 52.

The interior detail of the dispenser 47 is illustrated in FIG. 7. The view of the dispenser 47 in FIG. 7 is from the opposite side of that illustrated in FIG. 6. It will be seen that the water outlet 52 and water inlet 53 communicate with a chamber 61 divided into upper and lower portions by a diaphragm 62. Supported by the diaphragm 62 is a valve stem 63 which in its rest position illustrated in FIG. 7 closes a valve seat 64 which is directly connected to the detergent container 46 as illustrated in FIG. 6. The valve stem 63 is maintained in its closed rest position illustrated in FIG. 7 by means of a spring 65.

It will also be seen in FIG. 7 that the rinse aid inlet 49 is directly connected to the drain connector outlet 51. Also the rinse aid inlet 49 is connected via solenoids 54 and 55 respectively to the rinse aid outlet 50 and the lower portion of the chamber 61. As also seen in FIG. 7, the rinse aid line 60 connecting the rinse aid outlet 50 with the water outlet 52 does so by means of an orifice 65 in the water outlet 52.

It will be apparent from a consideration of FIGS. 6 and 7 that when rinse aid is supplied under pressure from the rinse aid pump 48, operation of solenoid 55 supplies pressurized rinse aid to the lower portion of the chamber 61 thereby moving the diaphragm 62 upwardly so as to raise the valve stem 63 and allow detergent to be dispensed into the upper portion of the chamber 61. This detergent is entrapped in water flowing from water inlet 53 to the water outlet 52. When the solenoid 55 is no longer operated, the diaphragm 62 returns to its rest position illustrated in FIG. 7 thereby lowering the valve stem 63 and preventing further flow of liquid detergent. However, the valve stem 63 and the lower portions of the valve seat 64 continue to be washed by water passing from the water inlet 53 to water outlet 52 thereby ensuring that the liquid dishwasher detergent dispensing valve remains clean and therefore cannot become clogged with dried detergent.

The operation of the control system illustrated in FIG. 6 is as follows. Firstly, the rinse aid pump 48 is operated so as to fill the line 57 and the lower portion of chamber 61 with rinse aid. Any bubbles are removed by bleeding to enable the rinse aid to operate effectively as an hydraulic fluid.

After the "normal" cycle has been selected on the control panel 4 (FIG. 1), the solenoid 56 is operated so as to close the drain closure member 14. Then the sink is filled to its operating level with hot water under the control of solenoid 19 (FIG. 2). When the appropriate level of hot water in the bowl 1 is reached, solenoid 19 is de-energized to stop the filling action. Then the pump 13 is operated so as to draw water already in the bowl 1 from the interior of the hollow body 20 through the filter 66, through the pump 13 where it is returned to the opening 23 and passes into the spray arms 28,32. This action is continued for 30 seconds in order to wash any larger dirt and grime particles from the dishes and utensils continued in the bowl 1.

Then the solenoid 56 is de-energized thereby allowing the torroid 41 to return to its normal size which dumps the contents of the bowl 1 into the drain 15.

The solenoid 56 is then re-energized in order to close the drain closure member 14, and the bowl 1 is again filled with hot water. However, on this occasion the solenoid 55 is energized so as to dispense detergent into the hot water during the filling of the bowl 1. A wash cycle of 4 minutes duration then follows during which the hot water containing detergent located within the bowl is cycled by the pump 13 through the spray arms 28,32. At the conclusion of this action, the solenoid 56 is again de-energized so as to allow this water to be dumped into the drain 15.

The bowl 1 is then again filled with hot water following re-energization of the solenoid 56, however, during this filling operation the solenoid 54 is energized so as to dispense rinse aid into the hot water. A washing cycle of approximately 2 minutes duration is then undertaken with the water containing rinse aid. At the end of this period, the solenoid 56 is again de-energized thereby dumping the water containing rinse aid into the drain 15.

The final portion of the normal cycle is to allow the dishes and utensils contained in the basket 11 to dry by absorbing heat which is retained by the metal bowl 1. This provides a satisfactory arrangement provided that the cover 7 is vented so as to allow water vapour to escape into the atmosphere. The total cycle time for the normal cycle is approximately 12½ minutes.

Variations to the normal cycle can be provided as follows. A "rinse cycle" in which only the first stage of washing grime from the dishes and utensils is carried out, a "heavy duty cycle" in which the 4 minute wash is repeated, and a "glass cycle" in which the initial rinse is with cold water (supplied via solenoid 67) rather than hot water to prevent the dry glasses being subjected to thermal shock which may shatter them.

Turning now to FIG. 8, an alternative embodiment of the spray arm arrangement and an alternative embodiment of the drain closure member are illustrated.

The housing 18 and drain 15 are substantially as before, however, only a pair of opposed spray arms 128 are provided in a single tier. The arms 128 are rotatably mounted on a hollow plastics turret 127. The turret 127 is in turn releasably secured to a central collar 121 which is supported by webs 22 as before. The collar 121 is supplied with water from the pump by means of the hollow elbow 25 as before. The spray arms 128 are removable from the sink 2 by dis-engagement of the turret 127 from the collar 121.

The arrangement of the hollow body 20 is substantially as before save that a dome-shaped cap 140 is provided to enable the drain 15 to be opened or closed. The cap 140 is mounted on a shaft 141 which is slidably located in a sleeve 142 supported by radial webs 143. The lower end of the shaft 141 is pivotally connected to an L-shaped lever 144 which protrudes through an opening 145 in the drain 15.

The opening 145 is sealed by means of a flexible rubber boot 146. The lever 144 is connected to the armature 147 of a solenoid 148 by means of a latching mechanical linkage 149.

It will be apparent that operation of the solenoid 148 enables the lever 144 to raise or lower the cap 140. Since the diameter of the cap 140 matches the internal diameter of the drain 15, in the lowered position the cap 140 closes the drain 15 while in the raised position (as illustrated) the drain 15 is open.

The foregoing describes only some embodiments of the present invention and modifications, obvious to those skilled in the art, can be made thereto without departing from the scope of the present invention. For example, a heater can be provided to heat the water supplied to the bowl 1 should it not be sufficiently hot. Typically this means a temperature of approximately 60° C. The preferred form of cover 7 is a sandwich formed from two layers of plastic with insulating foam in between. The cover 7 is further preferably provided with a smooth downwardly facing concave surface which enables water to drain to the periphery of the cover and therefore prevents drops of water falling from the cover 7 onto the dried dishes at the conclusion of the cycle.

We claim:

1. A sink mounted dishwasher comprising a sink having a base and side walls, a drain located in said base, a spray arm removably and rotatably mounted in said sink drain and rotatable by water directed into said spray arm by a pump connected to said drain wherein a drain closure member is mounted in said drain below the pump connection and is operable between a drain closed configuration in which water in said sink can be circulated by said pump through said spray arm, and a drain open configuration in which water in said sink is drained under gravity directly via said drain through said drain closure member bypassing said pump.

2. A dishwasher as claimed in claim 1 wherein said drain closure member comprises a cap mounted for longitudinal reciprocal movement along said drain into and out of an enlarged drain portion, the diameter of said cap corresponding to that of said drain whereby said drain is open only when said cap is in said enlarged portion.

3. A dishwasher as claimed in claim 2 wherein said cap surmounts a shaft slidably retained within a sleeve, said sleeve being co-axially supported within said drain.

4. A dishwasher as claimed in claim 3 wherein said shaft is reciprocable by a solenoid activated mechanical linkage.

5. A dishwasher as claimed in claim 1 wherein said drain closure member comprises a hollow torroid of elastically deformable sheet material having its outer surface sealingly secured to the inner surface of said drain, the interior of said torroid being connected to a source of hydraulic fluid, said torroid when not pressurized by said fluid having an aperture therethrough through which liquid in said drain can pass, and said torroid when pressurized by said fluid expanding to constrict said aperture and substantially prevent the passage of liquid therethrough.

6. A dishwasher as claimed in claim 5 wherein said hydraulic fluid comprises rinse aid liquid.

7. A dishwasher as claimed in claim 1 and comprising a substantially cylindrical hollow body dimensioned to be insertable into said drain, a collar substantially co-axial with said cylindrical body and located at one, upper, end thereof by a plurality of supporting webs, said collar supporting said spray arm, a hollow elbow interconnecting said collar with an opening in the side wall of said body communicable with a pump outlet, said elbow communicating said pump outlet with a hollow interior of said spray arm via said collar without obstructing liquid draining from said sink between said webs and through said hollow body.

8. A dishwasher as claimed in claim 7 having a pair of spray arms arranged at the same height above the base of the sink.

9. A dishwasher as claimed in claim 7 wherein said spray arm is formed as an assembly having an upper arm and a lower arm and water passing through said collar is directed into both said arms via a dual co-axial poppet valve seated within said collar.

10. A dishwasher as claimed in claim 7 wherein said hollow body is perforated and comprises a filter leading to a pump inlet whereby any residue remaining on said filter is washed from said filter as water is drained from the sink.

11. A dishwasher as claimed in claim 1 and including an hydraulically operated liquid detergent dispenser, an hydraulically operated drain closure member, and an hydraulic control system therefor, said system comprising a reservoir for liquid rinse aid, a rinse aid pump having an inlet connected to said reservoir and an outlet connected to three solenoid valves, a first one of said solenoid valves communicating said rinse aid to said detergent dispenser to hydraulically control the operation of same, a second one of said solenoid valves communicating said rinse aid to said drain closure member to hydraulically control the operation of same, and the third one of said solenoid valves connecting said rinse aid to said dishwasher to dispense same.

12. A dishwasher as claimed in claim 11 wherein said rinse aid is dispensed in the outlet of the liquid detergent dispenser.

13. A dishwasher as claimed in claim 11 wherein said liquid detergent dispenser is coated in a water supply line and comprises a liquid tight housing divided into two compartments by a diaphragm, one of said compartments having an inlet and an outlet for connection to said water supply line, and a further connection to a source of said liquid detergent closed by a poppet valve having a stem extending into said one compartment and secured to said diaphragm, biasing means to urge said diaphragm away from said further connection to thereby maintain said poppet valve normally closed, and the other of said compartments being connectable to the outlet of said rinse aid pump to pressurize said other compartment and move said diaphragm against the urging of said biasing means to thereby open said poppet valve and dispense said liquid into said supply line via said one compartment.

14. A sink mounted dishwasher comprising a sink having a base and side walls, a drain located in said base, a spray arm removably and rotatably mounted in said sink and rotatable by water directed into said spray arm by a pump connected to said drain, wherein a drain closure member is mounted in said drain below the pump connection and is operable between a drain closed configuration in which water in said sink can be circulated by said pump through said spray arm, and a drain open configuration in which water in said sink is drained under gravity through said drain closure member, and wherein said drain closure member comprises a cap mounted for longitudinal reciprocal movement along said drain into and out of an enlarged drain portion, the diameter of said cap corresponding to that of said drain whereby said drain is open only when said cap is in said enlarged portion.

15. A dishwasher as claimed in claim 14 wherein said cap surmounts a shaft slidably retained within a sleeve, said sleeve being co-axially supported within said drain.

16. A dishwasher as claimed in claim 15 wherein said shaft is reciprocable by a solenoid activated mechanical linkage.

17. A sink mounted dishwasher comprising a sink having a base and side walls, a drain located in said base, a spray arm removably and rotatably mounted in said sink and rotatable by water directed into said spray arm by a pump connected to said drain, wherein a drain closure member is mounted in said drain blow the pump connection and is operable between a drain closed configuration in which water in said sink can be circulated by said pump through said spray arm, and a drain open configuration in which water in said sink is drained under gravity through said drain closure member, and wherein said drain closure member comprises a hollow torroid of elastically deformable sheet material having its outer surface sealingly secured to the inner surface of said drain, the interior of said torroid being connected to a source of hydraulic fluid, said torroid when not pressurized by said fluid having an aperture therethrough through which liquid in said drain can pass, and said torroid when pressurized by said fluid expanding to constrict said aperture and substantially prevent the passage of liquid therethrough.

18. A dishwasher as claimed in claim 17 wherein said hydraulic fluid comprises rinse aid liquid.

19. A sink mounted dishwasher comprising a sink having a base and side walls, a drain located in said base, a spray arm removably and rotatably mounted in said sink and rotatable by water directed into said spray arm by a pump connected to said drain, wherein a drain closure member is mounted in said drain below the pump connection and is operable between a drain closed configuration in which water in said sink can be circulated by said pump through said spray arm, and a drain open configuration in which water in said sink is drained under gravity through said drain closure member, said dishwasher further comprising a substantially cylindrical hollow body dimensioned to be insertable into said drain, a collar substantially co-axial with said cylindrical body and located at one, upper, end thereof by a plurality of supporting webs, said collar supporting said spray arm, a hollow elbow interconnecting said collar with an opening in the side wall of said body communicable with a pump outlet, said elbow communicating said pump outlet with a hollow interior of said spray arm via said collar without obstructing liquid draining from said sink between said webs and through said hollow body.

20. A dishwasher as claimed in claim 19 having a pair of spray arms arranged at the same height above the base of the sink.

21. A dishwasher as claimed in claim 19 wherein said spray arm has an upper and a lower tier and water passing through said collar is directed into both said tiers via a dual co-axial poppet valve seated within said collar.

22. A dishwasher as claimed in claim 19 wherein said hollow body is perforated and comprises a filter leading to a pump inlet whereby any residue remaining on said filter is washed from said filter as water is drained from the sink.

23. A sink mounted dishwasher comprising a sink having a base and side walls, a drain located in said base, a spray arm removably and rotatably mounted in said sink and rotatable by water directed into said spray arm by a pump connected to said drain, wherein a drain closure member is mounted in said drain below the pump connection and is operable between a drain closed configuration in which water in said sink can be circulated by said pump through said spray arm, and a drain open configuration in which water in said sink is drained under gravity through said drain closure member, said dishwasher further comprising an hydraulically operated liquid detergent dispenser, an hydraulically operated drain closure member, and an hydraulic control system therefor, said system comprising a reservoir for liquid rinse aid, a rinse aid pump having an inlet connected to said reservoir and an outlet connected to three solenoid valves, a first one of said solenoid valves communicating said rinse aid to said detergent dispenser to hydraulically control the operation of same, a second one of said solenoid valves communicating said rinse aid to said drain closure member to hydraulically control the operation of same, and the third one of said solenoid valves connecting said rinse aid to said dishwasher to dispense same.

24. A dishwasher as claimed in claim 23 wherein said rinse aid is dispensed in the outlet of the liquid detergent dispenser.

25. A dishwasher as claimed in claim 23 wherein said liquid detergent dispenser is located in a water supply line and comprises a liquid tight housing divided into two compartments by a diaphragm, one of said compartments having an inlet and an outlet for connection to said water supply line, and a connection to a source of said liquid detergent closed by a poppet valve having a stem extending into said one compartment and secured to said diaphragm, biasing means to urge said diaphragm away from said connection to thereby maintain said poppet valve normally closed, and the other of said compartments being connectable to the outlet of said rinse aid pump to pressurize said other compartment and move said diaphragm against the urging of said biasing means to thereby open said poppet valve and dispense said liquid into said supply line via said one compartment.

* * * * *

UNITED STATES PATENT AND TRADEMARK OFFICE

CERTIFICATE OF CORRECTION

PATENT NO. : 5,193,562

DATED : March 16, 1993

INVENTOR(S) : Ralph Anthony RIGBY, et al.

It is certified that error appears in the above-identified patent and that said Letters Patent is hereby corrected as shown below:

In Column 1, line 35, change the word "elbow" to read the word --below--.

In Column 3, line 8, change "alterative" to read --alternative--.

In Column 3, line 25, after the word "avoided" insert a period --.--.

In Column 4, line 7, change "vale" to read the word --valve--.

In Column 4, line 11, change "right and" to read --right hand--.

In Column 4, line 12, change "FIG. 3." to read --FIG. 4.--.

In Column 4, line 32, change "mans" to read the word --means--.

In Column 4, line 47, change "so a" to read --so as--.

In Column 4, line 53, change "potion" to read the word --portion--.

In Column 4, line 68, change "container" to read the word --containers--.

UNITED STATES PATENT AND TRADEMARK OFFICE

CERTIFICATE OF CORRECTION

PATENT NO. : 5,193,562

DATED : March 16, 1993

INVENTOR(S) : Ralph Anthony RIGBY, et al.

It is certified that error appears in the above-identified patent and that said Letters Patent is hereby corrected as shown below:

In Column 5, line 5, change "dispenser" to read --dispensers--.

In Column 8, line 40 (Claim 13, line 2), change "coated" to read --located--.

In Column 9, line 17 (Claim 17, line 6), change "blow" to read --below--.

Signed and Sealed this

Fifteenth Day of February, 1994

*Attest:*

*Attesting Officer*

Bruce Lehman

BRUCE LEHMAN

*Commissioner of Patents and Trademarks*